US005538597A

United States Patent [19]

Koso et al.

[11] Patent Number: 5,538,597

[45] Date of Patent: Jul. 23, 1996

[54] APPARATUS FOR THE DISCHARGE OF A MASS TOWER

[75] Inventors: Arto Koso; Voitto Reponen, both of Karhula; Reijo Vesala, Kotka, all of Finland

[73] Assignee: A. Ahlstrom Corporation, Noormarkku, Finland

[21] Appl. No.: 163,088

[22] Filed: Dec. 7, 1993

Related U.S. Application Data

[63] Continuation-in-part of Ser. No. 755,286, Sep. 6, 1991, abandoned.

[30] Foreign Application Priority Data

Sep. 5, 1990 [FI] Finland ..... 904374

[51] Int. Cl.[6] ..... D21C 7/08

[52] U.S. Cl. ..... 162/246; 162/52; 137/238; 137/590

[58] Field of Search ..... 162/17, 52, 236, 162/237, 246, 239; 137/238, 590

[56] References Cited

U.S. PATENT DOCUMENTS

| | | | |
|---|---|---|---|
| 2,772,864 | 12/1956 | Rich et al. | 259/37 |
| 3,787,284 | 1/1974 | Richter | 162/246 |
| 4,676,809 | 6/1987 | Fjällström et al. | 55/204 |
| 5,058,615 | 10/1991 | Timperi et al. | 137/1 |
| 5,087,171 | 2/1992 | Dosch et al. | 415/169.1 |
| 5,106,456 | 4/1992 | Voitto et al. | 162/17 |

FOREIGN PATENT DOCUMENTS

| | | |
|---|---|---|
| 323749 | 7/1989 | European Pat. Off. . |
| 150782 | 6/1919 | United Kingdom . |

OTHER PUBLICATIONS

European Search Report EP 0 475 669 A3, filed Sep. 4, 1991.

Copy (2 pp.) of article headed "Medium–consistency technology".

*Primary Examiner*—Peter Chin

*Attorney, Agent, or Firm*—Cohen, Pontani, Lieberman, Pavane

[57] ABSTRACT

An apparatus for the discharge of a mass tower containing medium to high consistency pulp and operable without the need for further dilution includes a vessel for storing the pulp; a suction duct extending from a zone of moving pulp to a region outside of the tower; and a pump attached to the end of the suction duct for discharging the pulp.

12 Claims, 7 Drawing Sheets

APPARATUS FOR THE DISCHARGE OF A MASS TOWER

RELATED APPLICATIONS

This application is a Continuation-in-part of U.S. Patent application Ser. No. 07/755,286, filed Sep. 6, 1991 , now abandoned.

FIELD OF THE INVENTION

The present invention relates to an apparatus for the discharge of pulp from a mass tower in the pulp and paper industry, wherein a suction duct extends from a zone of moving pump at one end to an area outside of the tower at the other end where it is attached to a pump.

BACKGROUND AND SUMMARY OF THE INVENTION

The present invention relates to an apparatus for the discharge of a mass tower filled with medium or high consistency pulp of the type used in the pulp and paper industry.

It is known in the art, to dilute medium and high consistency pulp down to a maximum consistency of about 6% before discharging it from the bottom portion of a mass tower by means of a conventional centrifugal pump. During the last decade, the use of centrifugal pumps for high consistency pulp has gained ground, and therefore, it is not surprising to find that the discharge of a mass tower has been carried out through the use of a so called MC®-pump. In the known art, an MC®-pump may be positioned at the bottom of the mass tower, and if required equipped as illustrated in European patent application 87117593 and publication 0323749 so as to ensure the flow of the pulp to the pump. However, it has been shown that it is more advantageous, in accordance with a preferred embodiment Of the invention, to arrange an MC®-pump to communicate with the wall of the mass tower, so as to pump diluted pulp therefrom. By using this kind of arrangement, pulp with at least two different consistencies can be discharged from the tower.

The above referenced pump, when arranged in communication with the mass tower, is in most cases attached to the conic wall portion thereof. However, when an MC®-pump is arranged in the above described manner, significant problems can develop. As time progresses, the output of the MC®-pump gradually decreases while the energy consumption increases. The conclusion that is reached is that the pump for some reason does not receive a sufficient amount of pulp, despite the addition of dilution water, which only offers a temporary solution to the problem.

As such, an object of the present invention and as proven during tests performed, is to eliminate the above described problems. To achieve the above objective, one end of a suction duct is positioned in a zone of moving pulp located in the interior of the tower while the other end is located in an area outside of the vessel where it is connected to a pump. The end of the duct within the vessel is disposed so as to be positioned beyond the pulp layer which thickens about the periphery of the vessel. By positioning the orifice of the suction duct in a region free from the thickened pulp layer and in a region of moving pulp, the inherent problems associated with the movement and pumping of medium to high consistency pulp from a mass tower can be obviated.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

BRIEF DESCRIPTION OF THE DRAWING

The present invention will be further described in more detail below with reference to the drawings, in which.

DETAILED DESCRIPTION OF THE PREFERRED EMBODIMENTS

Figure 1:
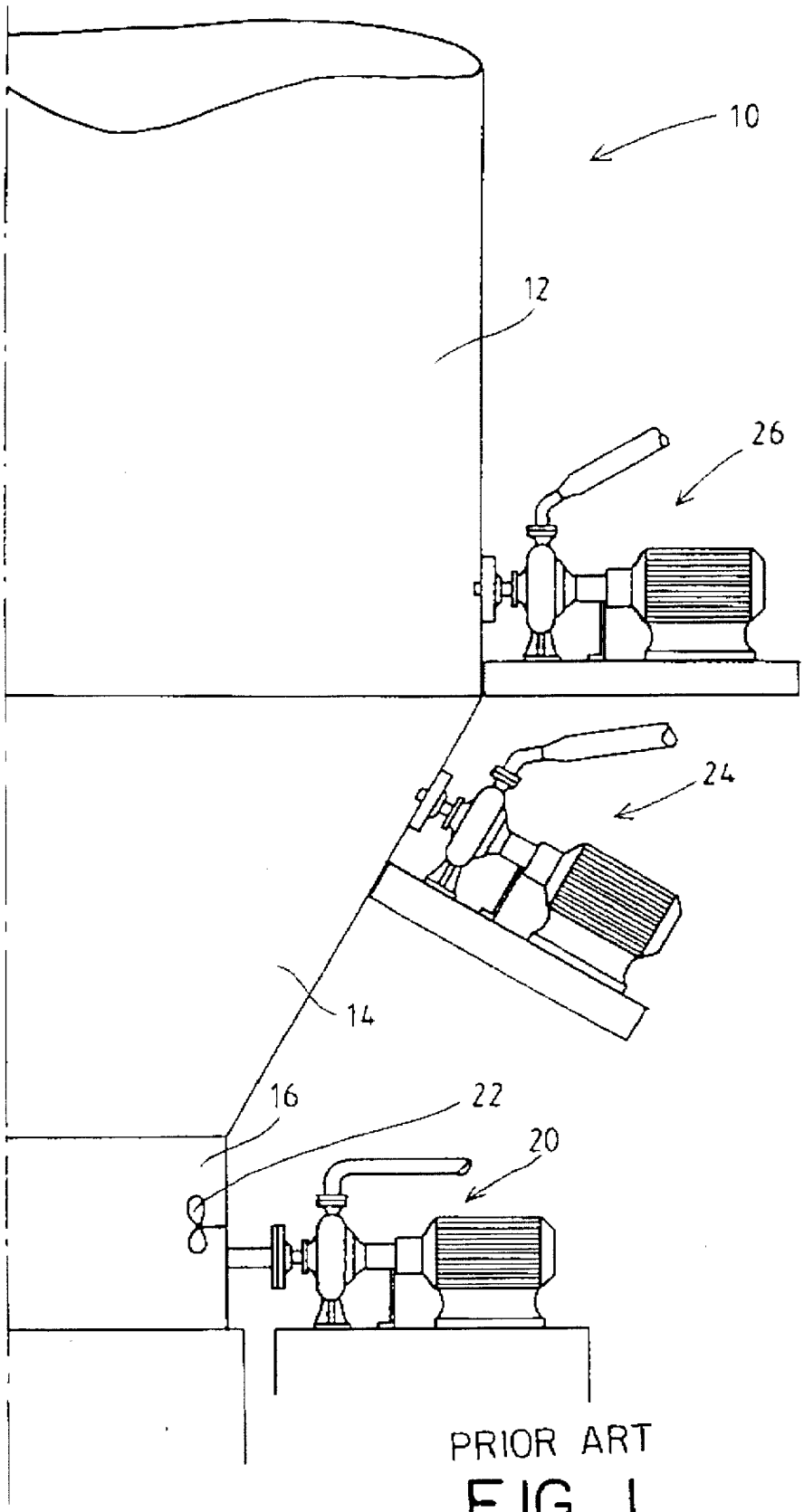
PRIOR ART FIG. 1
FIG. 1 schematically illustrates an arrangement in accordance with the prior art for the discharge of a mass tower.

In accordance with the known art, FIG. 1 illustrates a modern discharge configuration of a high consistency mass tower or vessel. A high consistency mass tower 10 as shown in FIG. 1, consists of two major portions: first, an upper part comprising, in this embodiment, a cylindrical wall portion 12 and a conical wall portion 14; and, second, in this embodiment, a cylindrical bottom part 16. A conventional centrifugal pump 20 designed for pumping low consistency pulp is attached to the wall of the cylindrical bottom part 16 of the tower. A feed conduit (not shown) for a dilution liquid and a mixer 22 for mixing the liquid into the pulp so as to improve the pumpability of the pulp have been positioned in front of pump 20 or, more broadly stated, in the bottom part 16 of the tower which may also be called as the diluting zone. The wall in the conical upper part 14 of the tower 10 has been provided with an MC®-pump 24, wherein the pulp is pumped without dilution and at its original consistency. Moreover, an MC®-pump may, either additionally or alternatively, also be attached to the cylindrical upper part 12 of the tower, as illustrated by an upper MC®-pump 26 in FIG. 1.

Naturally it has to be noted that the shape of the tower may be of whatever applicable shape, the drawings only show the most frequently used tower shape i.e. the one having a substantially narrow bottom portion for diluting the pulp and a wider upper part of the tower for, for instance, storing the pulp.

Figure 2:
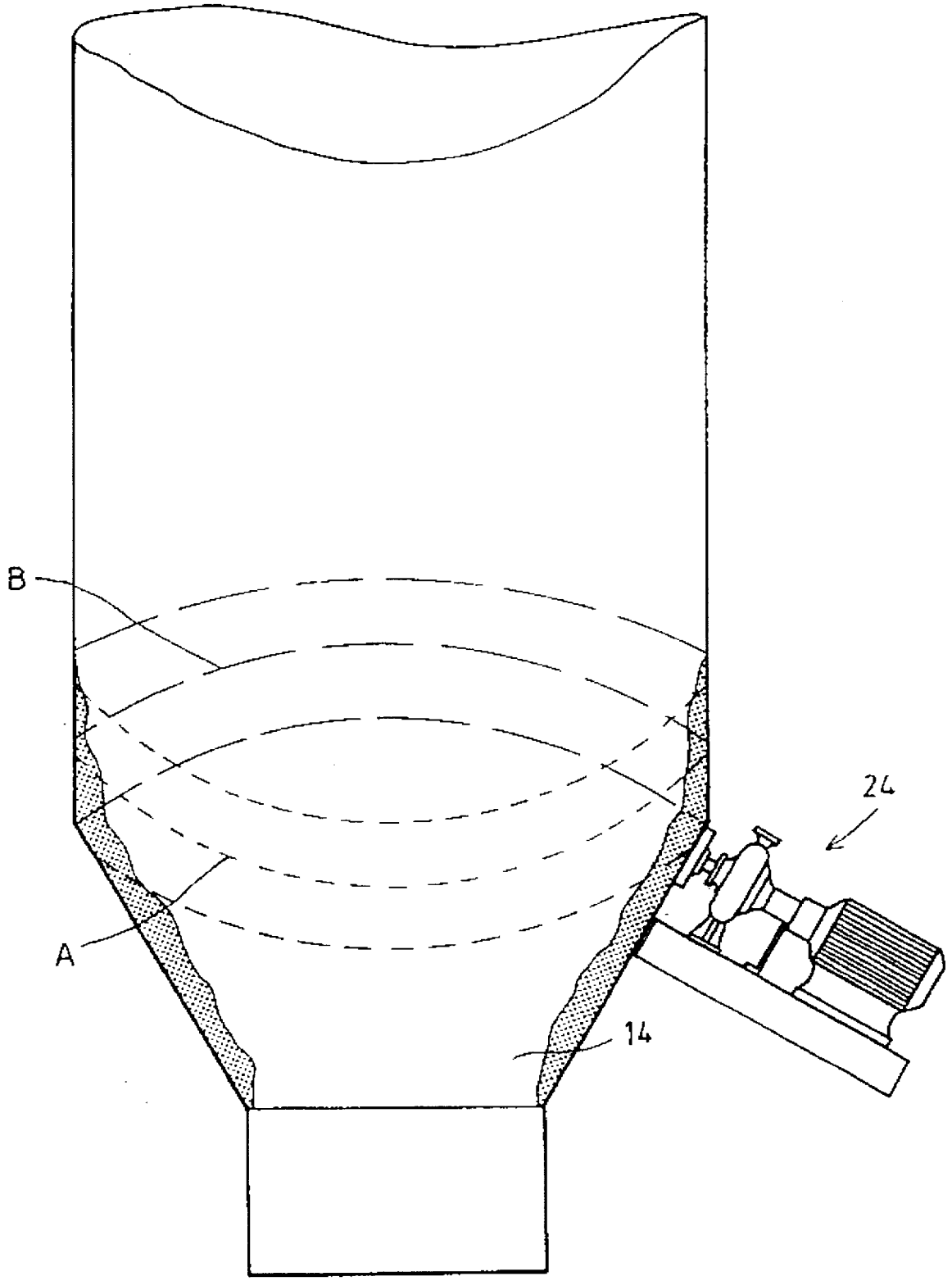
FIG. 2 schematically illustrates the generation of a pulp layer in the conical portion of the present invention.

FIG. 2 illustrates the theory of why the pumping of high consistency pulp at least from the vicinity of the conical upper portion of the tower does not succeed with conventional MC®-pumping means in the long run. The broken lines A and B in FIG. 2 show the variations of the pulp surface. It must be noted that whenever the surface of the pulp decreases, the pulp surface A in the center part of the tower is relatively lower than that portion of the surface found closer to the interior wall surface of the tower. The difference in level is due to the friction between the pulp and the wall of the tower. Moreover, the conical part of the tower forces the pulp to move towards the center of the tower, so as to contribute to the deceleration of the downward movement of the pulp. In addition, it has been found that the pulp thickens adjacent to the tower wall. The reason being that the liquid in the pulp moves more readily than the pulp and flows in a downward direction. Accordingly, liquid adjacent or in proximity to the wall is more readily filtrated. The greater the disparity in level between the pulp surface A in the center of the tower and the pulp adjacent to the tower wall, the greater the filtering capability and the greater is the increase in the consistency of the pulp at the periphery of the tower. When the lower is filled (broken line B), the effects are reversed. The pulp accumulating at the center of the tower follows the profile of curves B, but when the surface again decreases, the pulp adjacent to the wall quickly regains its original consistency. When the pulp is sufficiently thickened in close proximity of the walls thereof it does not move downwards in the tower, but forms a thickened pulp layer at least in the conical part 14, said pulp layer continually thickening as time progresses. During experiments, it has been noted that the consistency of such a layer rises above 20%. If under these circumstances, an MC®-pump 24 attached to the conical part of the tower is used for pumping the pulp, the pump operates well at the onset, but as time progresses, the pump's pumping capability decreases. The decrease in pumping capability is due to a build up of a pulp collar surrounding the suction opening of the pump 24, at the edge of the influence range of the fluidizing rotor. The less, i.e., the shorter the distance, the rotor extends into the vessel, the sooner the pump encounters the difficulties referenced above in properly receiving pulp.

Figure 3:
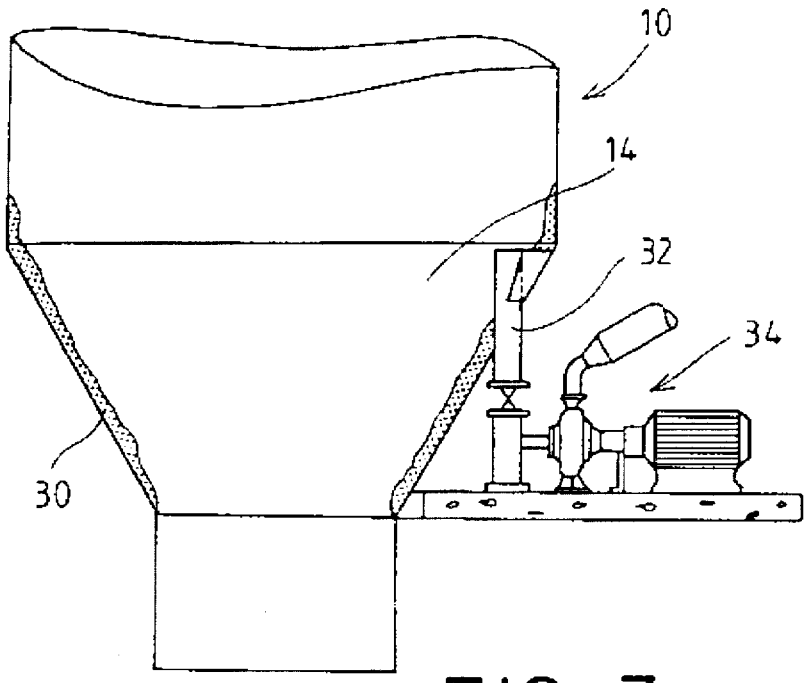
FIG. 3 schematically illustrates an arrangement in accordance with a preferred embodiment of the present invention.

FIG. 3 illustrates a solution to the above mentioned problem. A vertical suction duct 32 is disposed through a wall 30, preferably through the conical part 14 (if such exists) of the mass tower 10, so as to reach far enough inside of vessel 10, and extend through the thickened pulp layer and into the zone of moving pulp. Moreover, the suction opening of the duct is preferably open against the flow direction of the pulp during discharge, so that there is no need to doubt that the pulp will flow down to the bottom of said suction duct 32, and wherein said bottom of said suction duct 32 is provided with a separate pump 34, preferably also an MC®-pump. It must be further noted that the realization of the arrangement in accordance with the present invention is characterized in that the bottom part of the tower is provided with means for discharging a first portion of pulp from the vessel. Usually said means is a pump (not shown), by which pulp is pumped substantially continuously from the vessel 10, and which causes the continuous flow of the pulp past the orifice or the so-called suction opening of the suction duct 32. However, said means may also be a mere opening and a discharge conduit attached thereto if the pulp is diluted to a sufficiently low consistency whereby the pulp is able to flow out of the vessel due to mere gravity. The extension of the suction duct 32 into the inside of the vessel, i.e., the distance of the suction duct opening from the inner surface of the tower wall is preferably, according to the results of experimentation, at least about 25% of the diameter or width of the suction duct depending on its cross-sectional shape. Of course, if the extension of the duct is greater than about 25%, of the diameter, the discharge of the pulp will not be hindered. However, if the extension or length of the duct falls below approximately 25%, problems may be encountered in the case of easily filtered pulp types.

Figure 4:
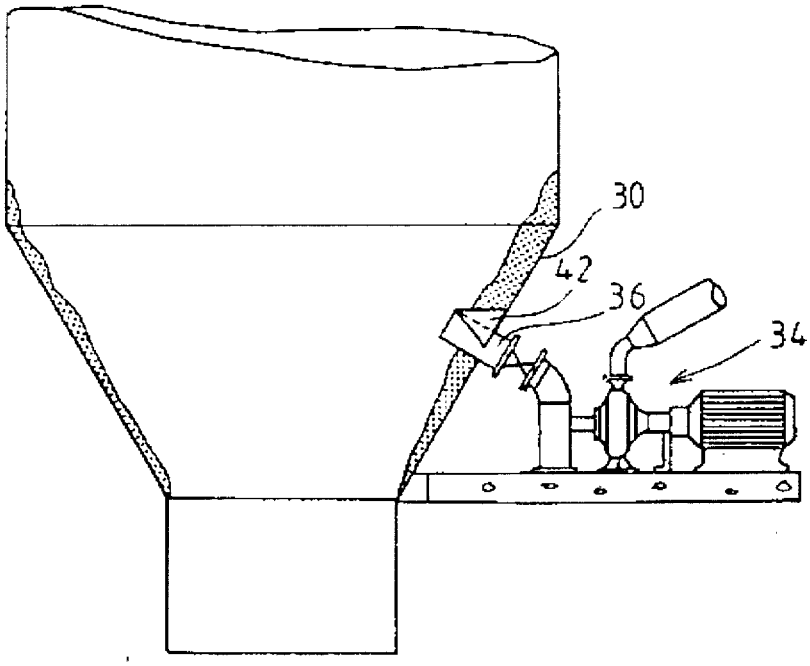
FIG. 4 schematically illustrates an arrangement in accordance with a second embodiment of the present invention.

FIG. 4 additionally illustrates an alternative embodiment, wherein a suction duct 36 is disposed upright with respect to the conical wall portion 30. An additional advantage for both arrangements is that the fluidizing MC®-pump 34 or the device disclosed in FIG. 7 of European patent application 88312336 can be positioned on a conventional base, i.e. horizontally, instead of hanging perpendicularly with respect to the wall of the mass tower, as is characteristic of the previous technique.

In addition, the embodiments as shown in FIGS. 3 and 4 incorporate the use of a collar plate 42 mounted either on the suction duct (32, 36) or on the tower wall so as to cover a pocket generated between the suction duct and the tower wall and wherein pulp would otherwise tend to accumulate. The collar plate 42 is preferably formed so as to deflect pulp to the sides of the suction duct, thereby preventing the generation of a pulp layer on the collar plate.

Figure 5:
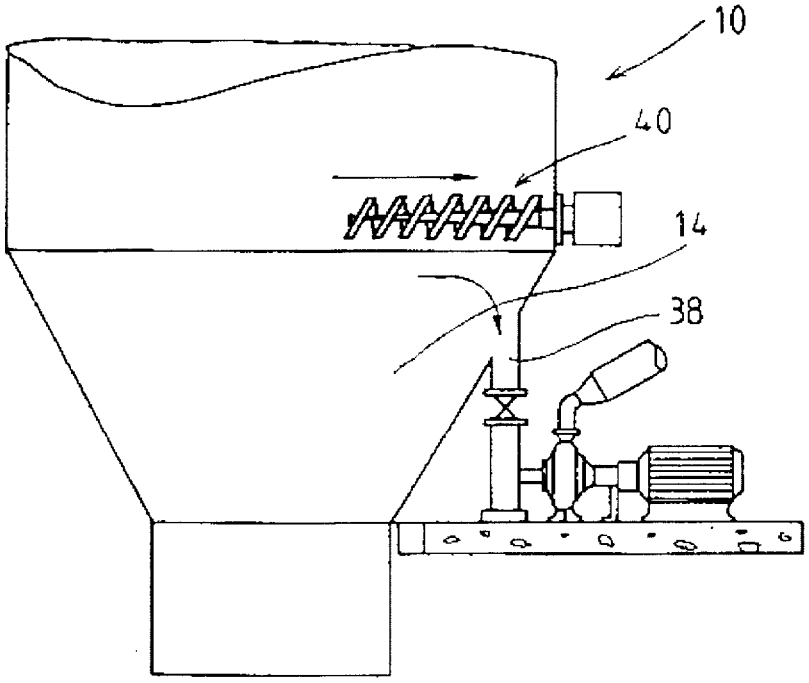
FIG. 5 schematically illustrates a third embodiment of the present invention.

In yet another embodiment, FIG. 5 illustrates how an open screw 40 can be arranged in front of, or above, the opening of an upright suction duct 38 so as to prevent the generation of a thickened pulp layer in front of the suction duct 38 and to transfer pulp towards the orifice, of the suction duct 38. By means of forcing the pulp to flow against the wall of the pulp tower the generation of the pulp layer on the vessel wall is prevented whereby the pulp is able to flow downwardly into the opening of the suction duct.

Figure 6:
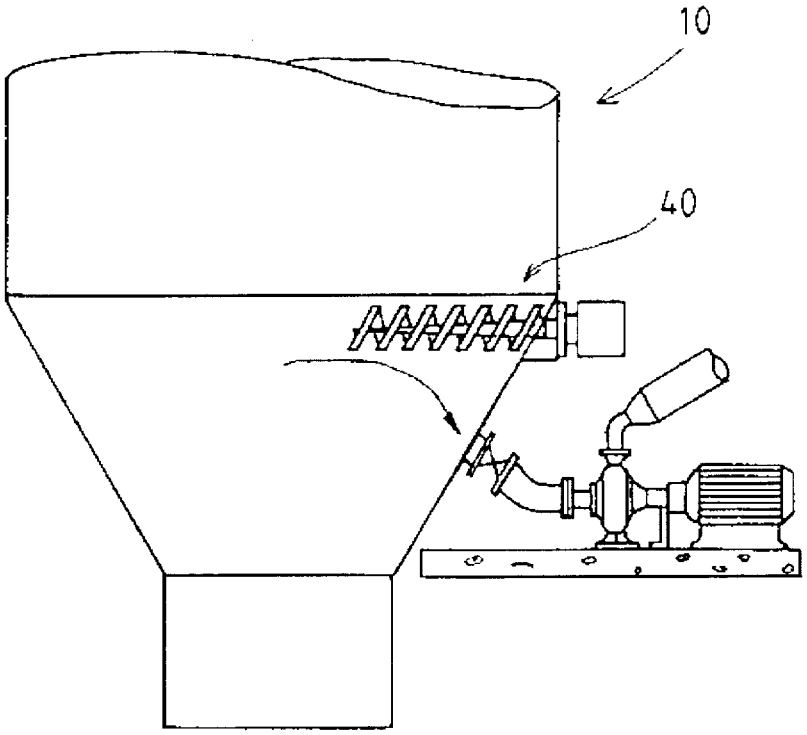
FIG. 6 schematically illustrates a fourth embodiment of the present invention.

FIG. 6 illustrates a similar arrangement disposed in front of, or above, the orifice of the discharge duct for pulp located upright with respect to the conical part of the wall. The purpose of the screw 40 is to feed pulp towards the wall of the mass tower 10 and thus prevent the generation of pulp layer tending to accumulate on the wall. The screw does not actually operate as a feeding apparatus for the suction duct, but prevents the thickening of the pulp on the surface of the mass tower by feeding the pulp against the wall of the mass tower.

Figure 7A:
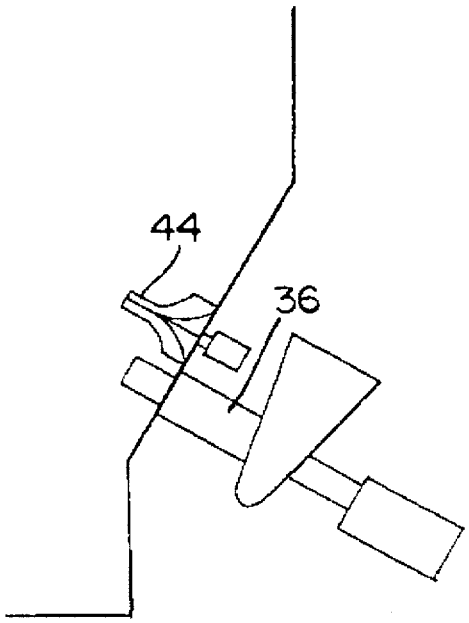
FIGS. 7*a* and *b* illustrate a fifth and a sixth embodiment of the present invention.
Figure 7B:
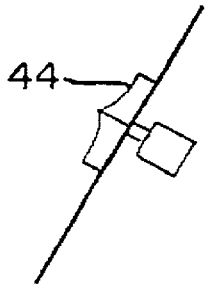

FIGS. 7*a* and 7*b* illustrate a rotating scraper which may also be used for a similar purpose, wherein a scraper mechanically loosens the pulp layer which accumulates on the wall.

Figure 8:
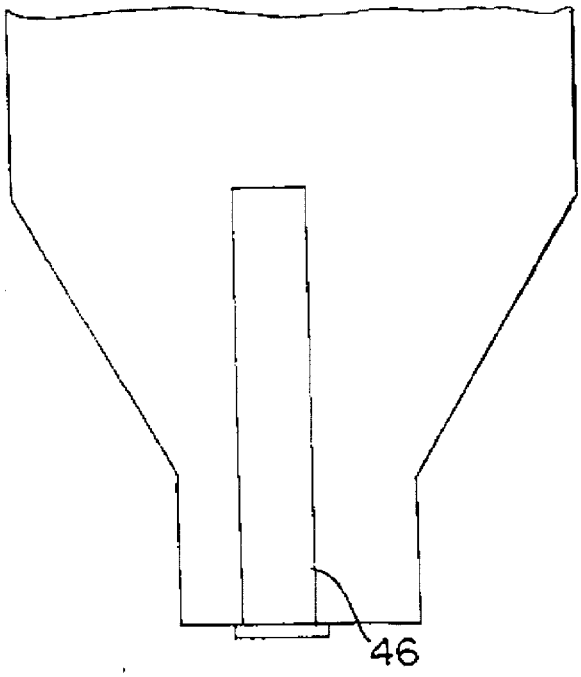
FIG. 8 is a schematic illustration of yet another embodiment of the preferred invention.

FIG. 8 illustrates yet another embodiment of the invention. The suction duct 46 is, in accordance with the invention, arranged to extend through the bottom of the pulp tower to the upper part of the pulp tower i.e. well above the dilution zone so that the pulp may be discharged from the tower in its original consistency. The advantage of this embodiment is that both the MC®-pump and the pump pumping the diluted pump may be arranged on the same base plate underneath the pulp tower. The embodiment is especially designed for cases where there is sufficient space beneath the pulp tower for placing the pumps.

Figure 9:
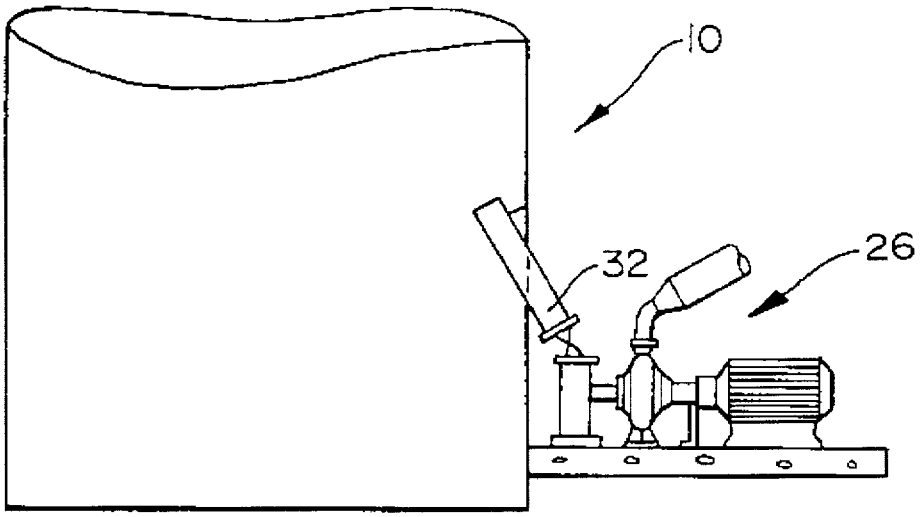
FIG. 9 is a schematic illustration of yet another embodiment of the preferred invention.

FIG. 9 is a schematic view of the present invention wherein a wall portion of the pulp containing vessel 10 is formed by a cylindrical wall and wherein the suction duct 32 extends through the vessel wall into the vessel 10.

Figure 10:
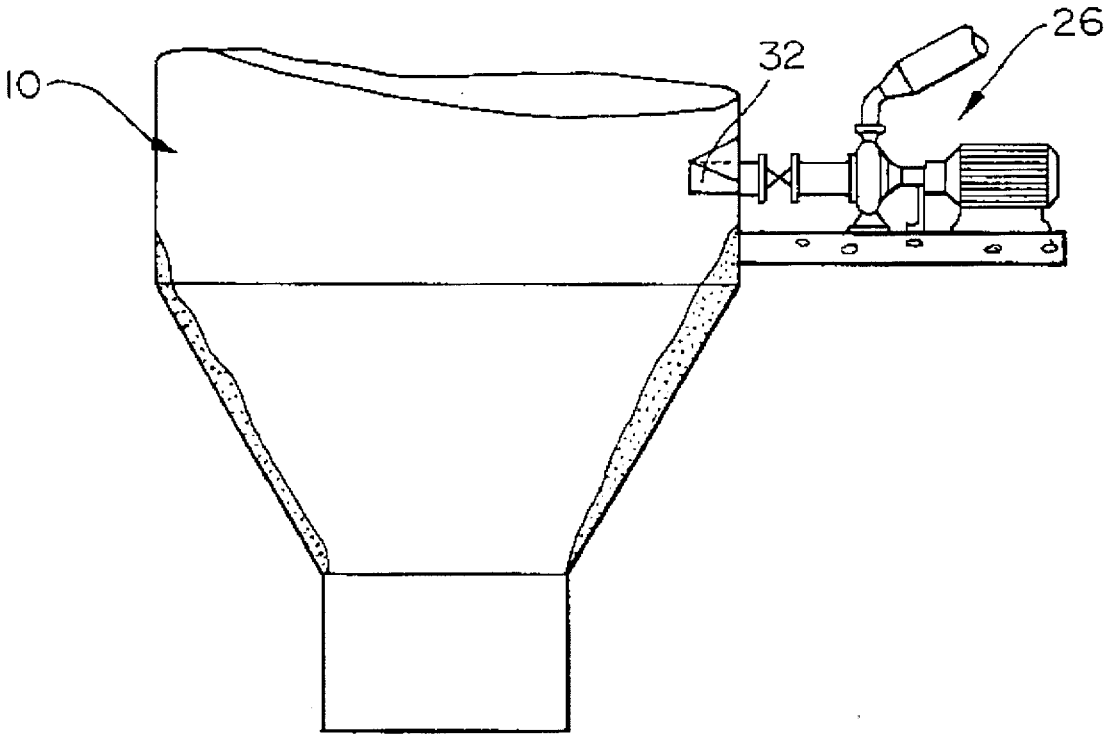
FIGS. 10 and 11 is a schematic illustration of yet another embodiment of the preferred invention.

FIG. 10 shows a pulp containing vessel 10 having a conical wall portion and above the cylindrical wall portion a wall portion which is at least partially formed of a cylindrical wall and wherein the suction duct 32 extends through the cylindrical portion of the vessel.

Figure 11:
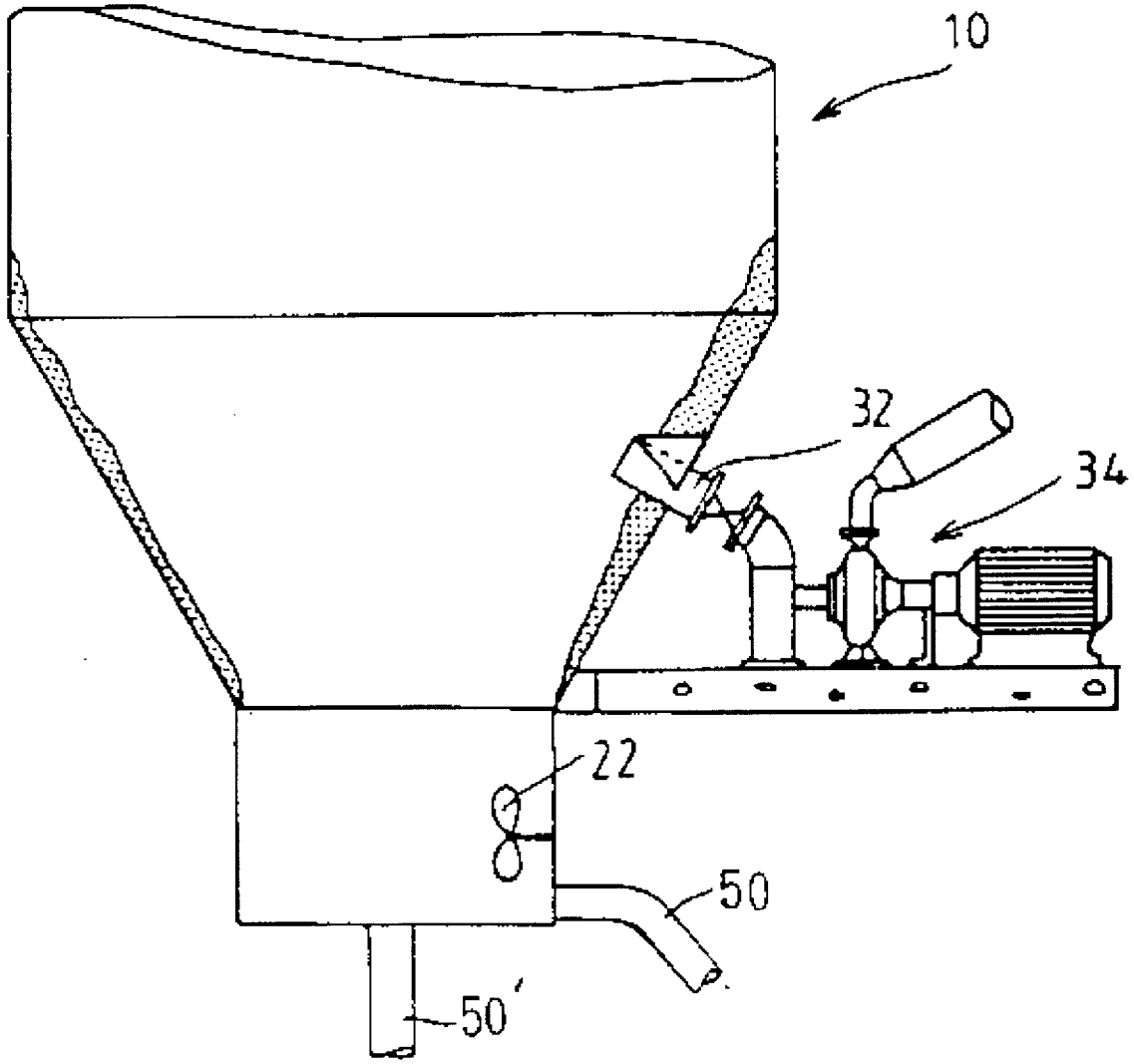

FIG. 11 shows a pulp containing vessel 10 in which a conduit 50 for discharging a portion of the pulp is attached to the lower cylindrical wall portion of the vessel. Alternatively, the conduit may also be attached to the bottom of the pulp vessel as shown in dotted lines by the numeral 50'.

As is readily apparent from the above description, a new apparatus has been developed for the reliable and safe discharge of pulp from mass towers without the need to dilute the pulp. It must be recognized however, that the above description discloses only a few embodiments of the invention. In reality the apparatuses may deviate considerably from the above described embodiments and may still be within the scope of the appended patent claims. Thus, it is quite possible that the suction duct in accordance with the present invention is arranged in an inclined position with respect to the cylindrical part of the mass tower, or that the screw shown in the drawings is positioned in some position other than a completely horizontal position or that the vessel is completely cylindrical or shaped in some other form appropriate for the purpose, or that the suction duct of the vessel has been extended deep into the vessel, for example in the way shown in FIG. 8, just to mention a few of the variations of the invention.

Thus, it should be understood that the preferred embodiments and examples described are for illustration purposes only and are not to be construed as limiting the scope of the present invention which is properly delineated only in the appended claims.

The invention is not limited by the embodiments described above which are presented as examples only but can be modified in various ways within the scope of protection defined by the appended patent claims.

What is claimed is:

1. An apparatus for discharging medium or high consistency undiluted pulp from a pulp containing vessel of the type having a bottom part with a bottom and a first wall portion connected to the bottom part; an upper part with a second wall portion located above said first wall portion and connected to the first wall portion so that the wall portions define the pulp vessel, said second wall portion having an interior surface; and first means for discharging a first portion of said pulp from said bottom part of said vessel so that a zone of downwardly moving pulp is generated within said vessel, said apparatus comprising: a suction duct having an interior end and an exterior end, said suction duct having a substantially uniform cross-section and being mounted through said second wall portion so that said interior end extends into said upper part of said vessel so that said interior end of said duct is located within said zone of moving pulp and said exterior end of said duct is located outside said vessel; second means including a pump operatively connected to said exterior end of said suction duct for discharging a second portion of said pulp from said zone of moving pulp; and a pulp source for supplying pulp to the vessel.

2. The apparatus according to claim 1, wherein said second wall portion is formed of a cylindrical wall and wherein said suction duct extends through said wall into said vessel.

3. The apparatus according to claim 1, wherein said second wall portion is at least partially formed of a conical wall and disposed above said first wall portion; and wherein said suction duct is disposed in said conical wall of said vessel.

4. The apparatus according to claim 1, wherein said second wall portion also comprises a substantially cylindrical wall above said conical wall; and wherein said suction duct is disposed in said cylindrical wall of said vessel.

5. The apparatus according to claim 2, wherein said suction duct is disposed in an inclined position relative to said second wall portion of said vessel.

6. The apparatus according to claim 3, wherein said suction duct is disposed in an inclined position relative to said second wall portion of said vessel.

7. The apparatus according to claim 4, wherein said suction duct is disposed in an inclined position relative to said second wall portion of said vessel.

8. The apparatus according to claim 3, wherein the suction duct is disposed in an upright position relative to said second wall portion of said vessel.

9. The apparatus according to claim 1, wherein said suction duct extends through said bottom part of said vessel to said zone of moving pulp into said upper part of said vessel.

10. The apparatus according to claim 1, wherein said interior end comprises an interior opening having a width and said duct extends beyond the interior surface of said vessel by at least 25% of the width of said interior opening.

11. The apparatus according to claim 1, wherein said first means for discharging a first portion of said pulp is a conduit attached to one of said bottom_and said first wall portion.

12. The apparatus according to claim 1, wherein said first means for discharging a first portion of said pulp is a centrifugal pump attached to one of said bottom and said first wall portion.

* * * * *